US007028590B2

(12) United States Patent
Tuan Mu

(10) Patent No.: US 7,028,590 B2
(45) Date of Patent: Apr. 18, 2006

(54) RETRACTABLE OPEN END WRENCH

(75) Inventor: Hsien-Chung Tuan Mu, Taichung (TW)

(73) Assignee: Easco Hand Tools, Inc., Simsbury, CT (US)

( * ) Notice: Subject to any disclaimer, the term of this patent is extended or adjusted under 35 U.S.C. 154(b) by 24 days.

(21) Appl. No.: 10/840,772

(22) Filed: May 6, 2004

(65) Prior Publication Data

US 2005/0016335 A1 Jan. 27, 2005

(30) Foreign Application Priority Data

Jul. 22, 2003 (TW) ..... 92119982 A

(51) Int. Cl.
*B25B 13/12* (2006.01)

(52) U.S. Cl. ..... 81/179; 81/129

(58) Field of Classification Search ..... 81/179, 81/128, 129, 186

See application file for complete search history.

(56) References Cited

U.S. PATENT DOCUMENTS 659,293 A * 10/1900 Downey ..... 81/179
892,503 A * 7/1908 Corbin ..... 81/179
1,174,167 A * 3/1916 King ..... 81/179
1,483,110 A * 2/1924 Pearce et al. ..... 81/179
3,280,669 A * 10/1966 Weaver ..... 81/179
4,437,364 A 3/1984 Martinmaas ..... 81/179
6,089,129 A 7/2000 Huang ..... 81/133
6,945,143 B1 * 9/2005 Kim ..... 81/179

* cited by examiner

*Primary Examiner*—Debra S Meislin
(74) *Attorney, Agent, or Firm*—Nelson Mullins Riley & Scarborough, L.L.P.

(57) ABSTRACT

A retractable open-end wrench has a handle defining a web at one end thereof. A stationary jaw projects from a first side of the web, and a first channel is formed at a second side of the web opposite the first side, the first channel being defined by a first arc. A moveable jaw is received by the first channel and moves linearly through the first channel, wherein the jaws form an open end therebetween. A second channel formed in the movable jaw is defined by a second arc, wherein a length of the first arc is greater than a length of the second arc. Moreover, a first radius of the first arc is smaller than a second radius of the second arc, and the first channel and the second channel form a receiving hole.

27 Claims, 7 Drawing Sheets

RETRACTABLE OPEN END WRENCH

BACKGROUND OF THE INVENTION

1. Field of Invention

This invention relates to a wrench, particularly to a retractable open-end wrench allowing itself to recover to an orientation to facilitate further rotation without repeatedly drawing up and fitting itself onto a bolt or nut.

2. Description of the Related Art

Conventional wrenches for tightening or loosening bolts or nuts include locking and non-locking types in which the non-locking types allow for use with various sizes of bolts or nuts by adjusting an adjustment rack.

Regardless of being a locking type or a non-locking type wrench, a user must remove the jaws of the wrench from the bolt after the bolt or nut is tightened or loosened upon rotating the wrench over a certain angle in a tightening or loosening direction, recovering the wrench to an orientation facilitating further rotation under a state that the jaws disengage from the bolt or nut, and then fitting the jaws onto the bolt or nut to perform a subsequently tightening or loosening operation. Such operations must be repeated until the bolt or nut is completely tightened or loosened.

Removing and repositioning the wrench causes inconvenience for the user and requires additional space to accommodate the operation for removing the wrench from the bolt or nut for recovering the wrench to an orientation facilitating further rotation under a state that the jaws disengage from the bolt or nut.

To resolve such problems, U.S. Pat. No. 4,437,364 discloses a wrench allowing linear movement of a movable jaw of the wrench with respect to the web to increase a gap of the wrench. However, in such a conventional wrench, because the receiving hole facilitating linear movement of the movable jaw is formed on the web, a driller or a lathe must be implemented to drill a hole in the web, followed by a milling machine to mill a slot along a lateral face of the web in communication with the drill hole. The above manufacturing process requires the use of several machining equipment and creates problems in tapping and deburring the hole, particularly for small-size wrenches.

SUMMARY OF THE INVENTION

It is a primary objective of this invention to provide a retractable open-end wrench allowing easy manufacturing and deburring to reduce the manufacturing costs and lead-time.

It is further objective of this invention to provide a retractable open-end wrench allowing quick retraction of the wrench to an orientation facilitating further rotation without repeatedly drawing up the wrench.

It is further objective of this invention to provide a retractable open-end wrench allowing tightening or loosening a fastener without repeatedly fitting the wrench onto a bolt or nut.

To achieve the above objectives, the invention provides a retractable open-end wrench having: a web, a stationary jaw projecting from a side of the web, a movable jaw provided at another side of the web and forming an open end of a predetermined gap with the stationary jaw. The web is formed with a lower channel in operative engagement with the movable jaw, the lower channel having a major arc cross-section. The movable jaw is formed with an upper channel proximate the web, the upper channel having a minor arc cross-section having a radius slightly greater than a radius of the major arc. The upper channel and the lower channel jointly construct a receiving hole. A post projects from the movable jaw proximate the upper channel, the post having a cross-section corresponding to the cross-section of the lower channel to allow linear movement along the lower channel. A resilient member such as a spring is received in the receiving hole, the spring subjecting the post of the movable jaw to normally urge against the web and allowing linear movement of the movable jaw with respect to the web to thereby increase the predetermined gap.

According to another aspect of this invention, the retractable open-end wrench has a locking device such as a plug for retaining the spring in the receiving hole.

According to another aspect of this invention, the lower channel is formed with a plurality of threads at a distant end thereof for retaining the plug in the receiving hole.

According to another aspect of this invention, the spring is a compression spring provided between the post and the plug, or a tension spring provided between the post and the web.

According to another aspect of this invention, the retractable open-end wrench has a plug that is press-fitted in the receiving hole.

The structures and characteristics of this invention can be realized by referring to the appended drawings and explanations of the embodiments.

BRIEF DESCRIPTION OF THE DRAWINGS

FIG. 1(*a*) is a cross-sectional view illustrating a receiving hole for receiving a post in the wrench of FIG. 1.

FIG. 1(*b*) is a cross-sectional view illustrating a locking device being inserted in the receiving hole of FIG. 1(*a*).

FIGS. 3(*c*) to 3(*e*) are schematic views illustrating the operations for tightening a bolt.

FIGS. 4(*d*) to 4(*e*) are schematic views illustrating the operations for loosening a bolt.

DETAILED DESCRIPTION OF THE PREFERRED EMBODIMENT

Figure 1:
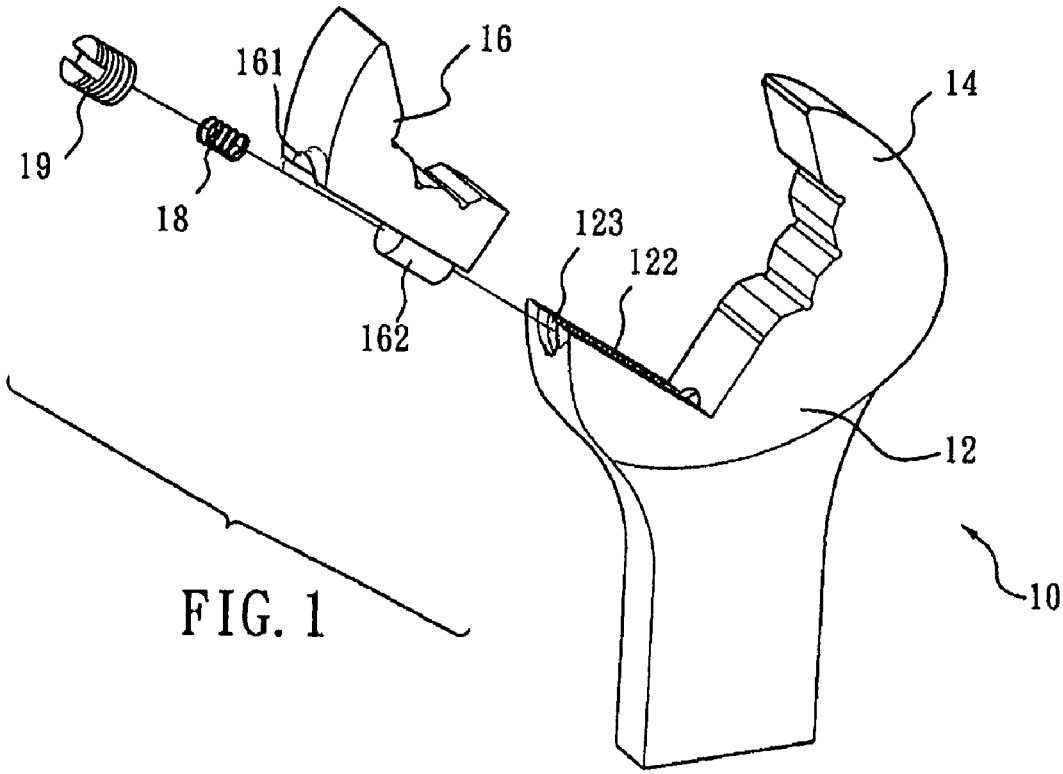
FIG. 1 is an exploded, perspective view of a retractable open-end wrench according to an embodiment of this invention.
Figure 1A:
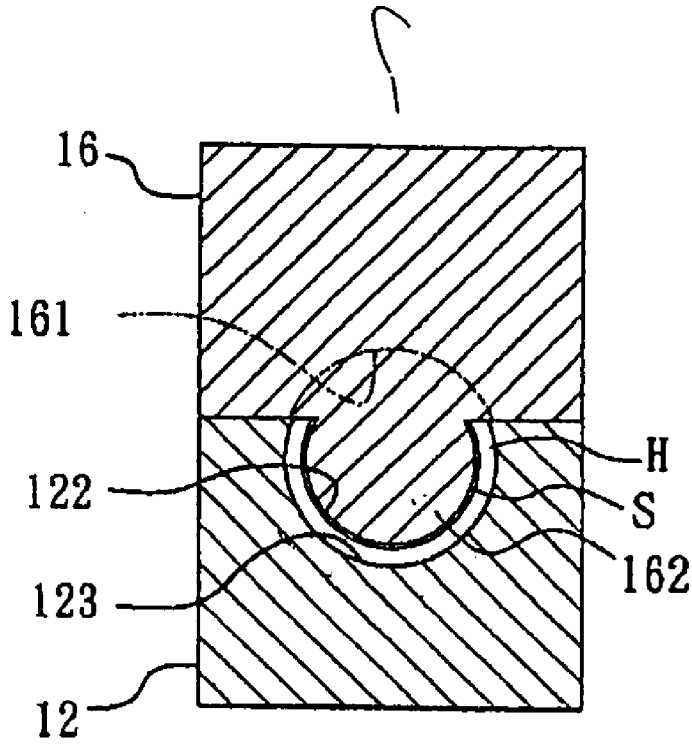
Figure 1B:
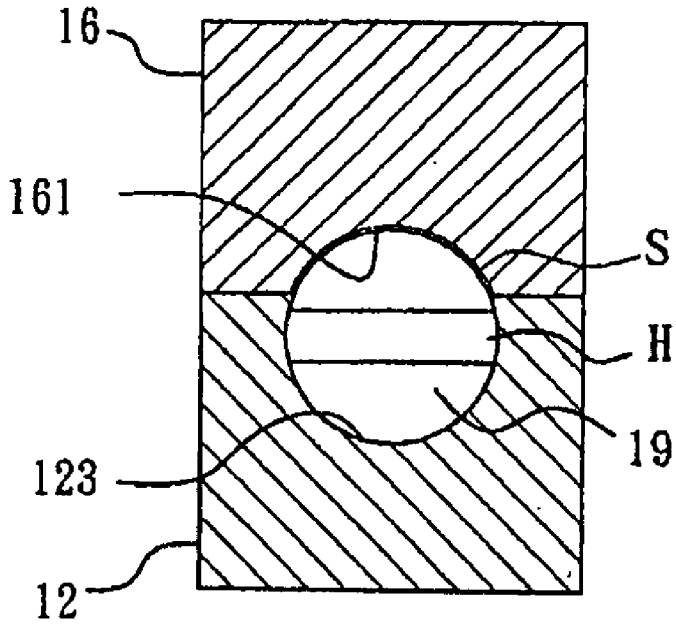
Figure 2:
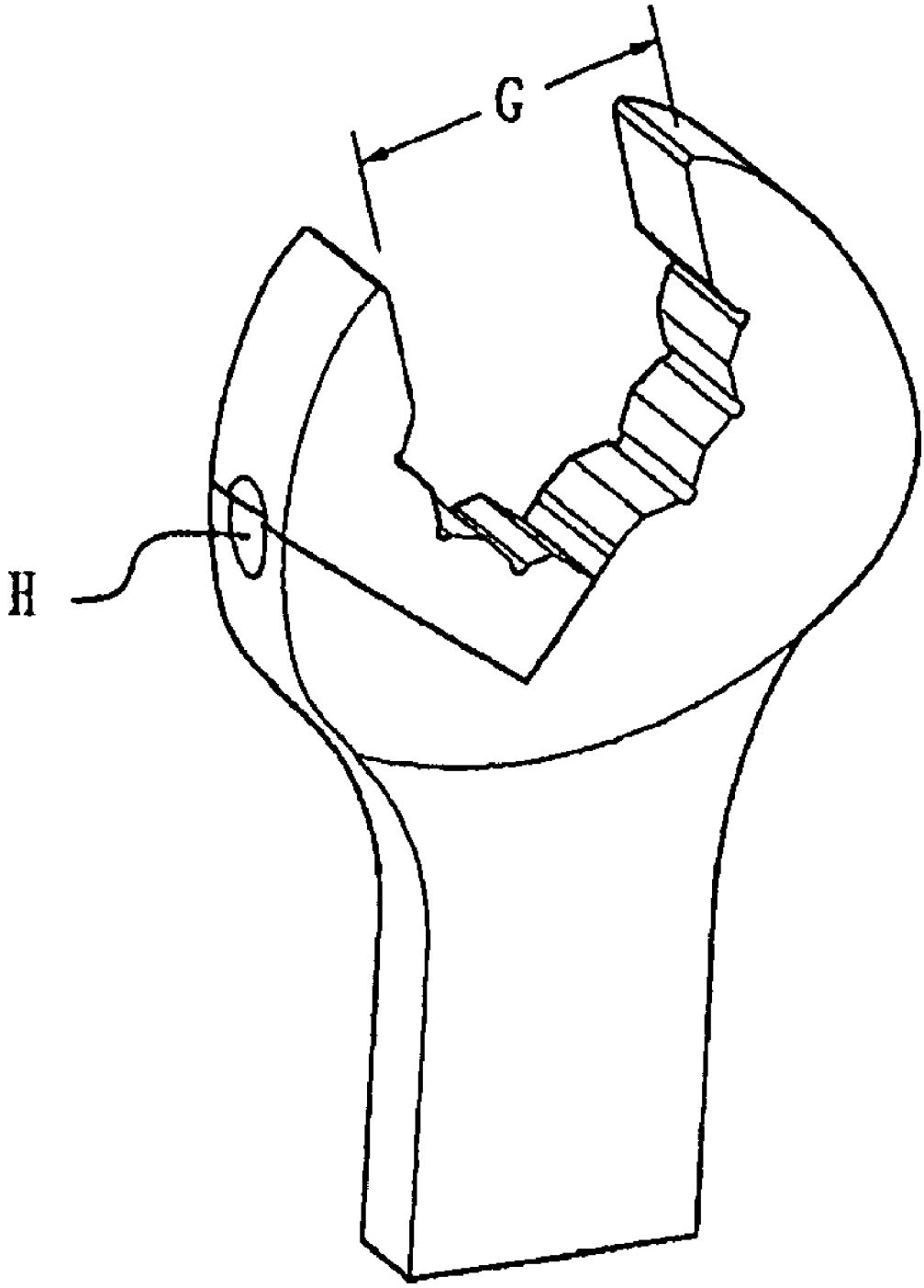
FIG. 2 is an assembled, perspective view of the retractable open-end wrench of FIG. 1.
Figures 3A, 3B:
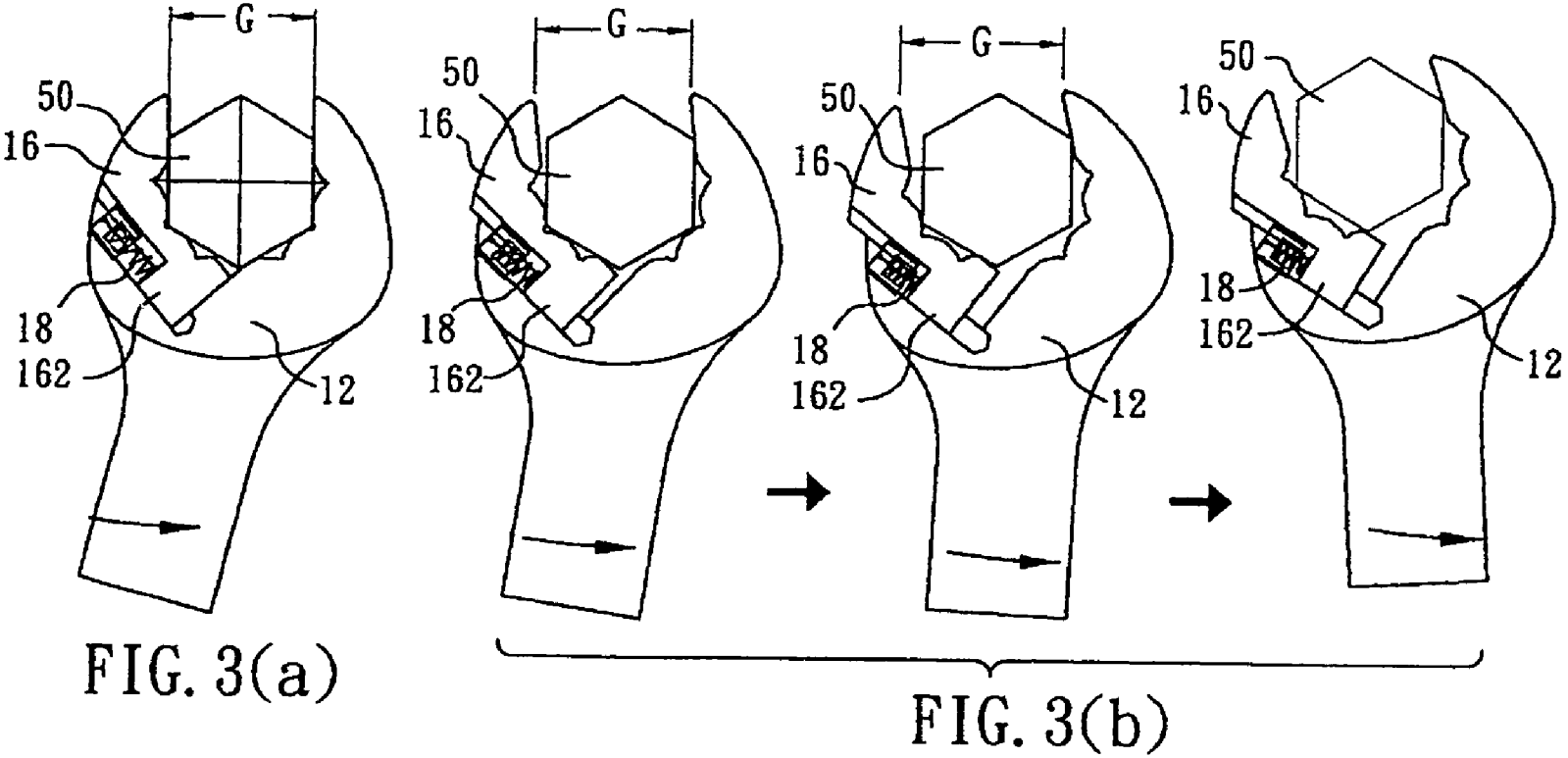
FIGS. 3(*a*) to 3(*b*) are schematic views illustrating the operations for retracting the retractable open-end wrench of FIG. 1 to an orientation facilitating tightening.
Figure 3E:
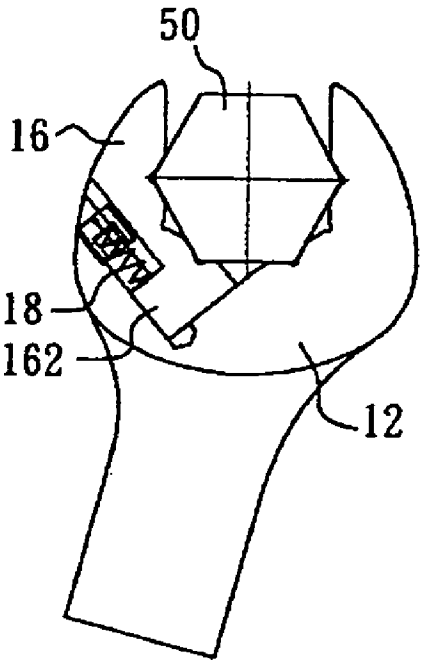
Figure 3D:
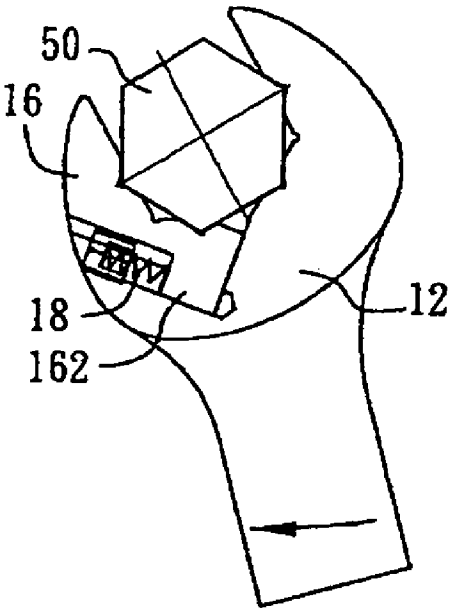
Figure 3C:
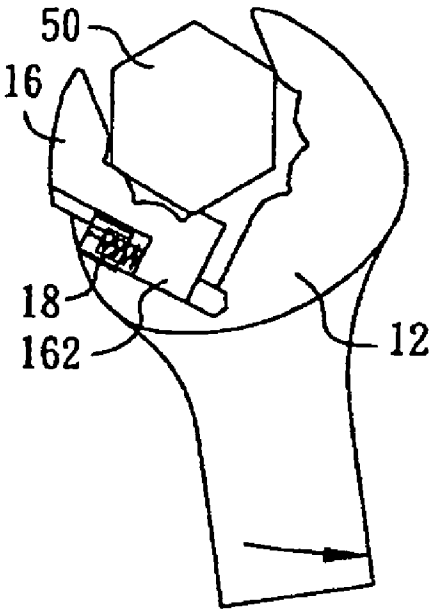
Figures 4A, 4B:
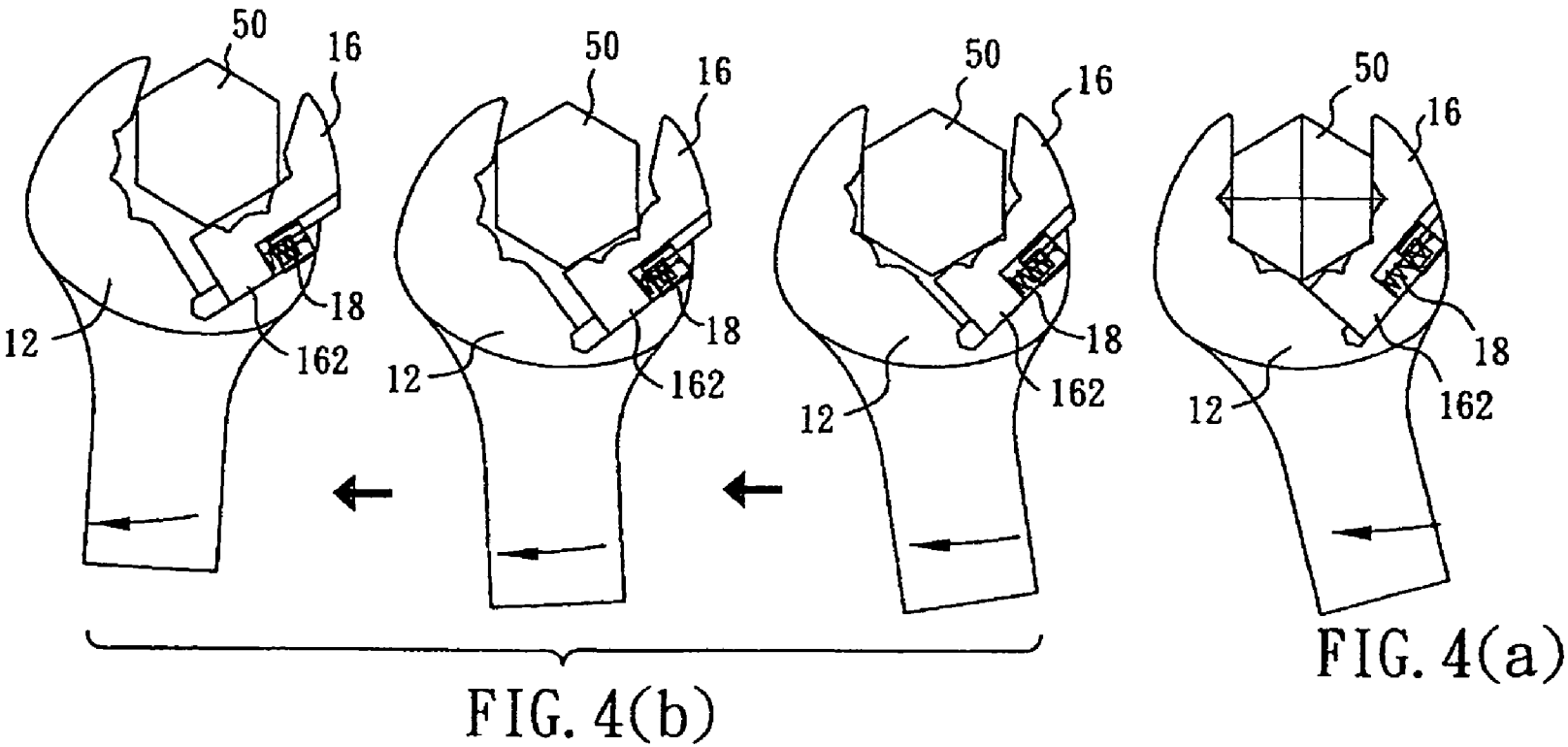
FIGS. 4(*a*) to 4(*c*) are schematic views illustrating the operations for retracting the retractable open-end wrench of FIG. 1 to an orientation facilitating loosening.
Figure 4C:
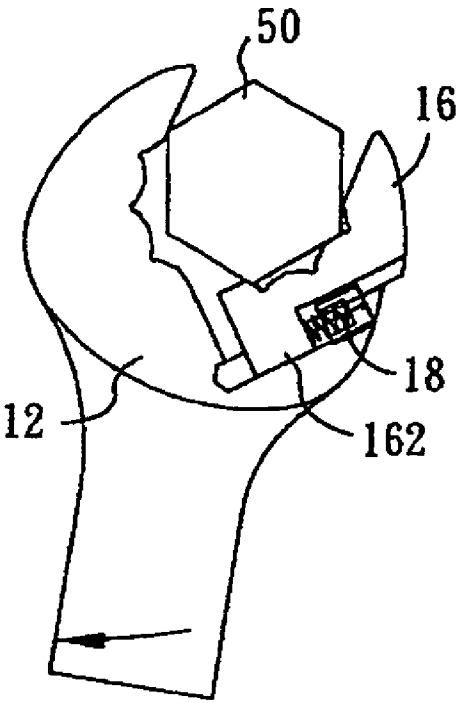
Figure 4D:
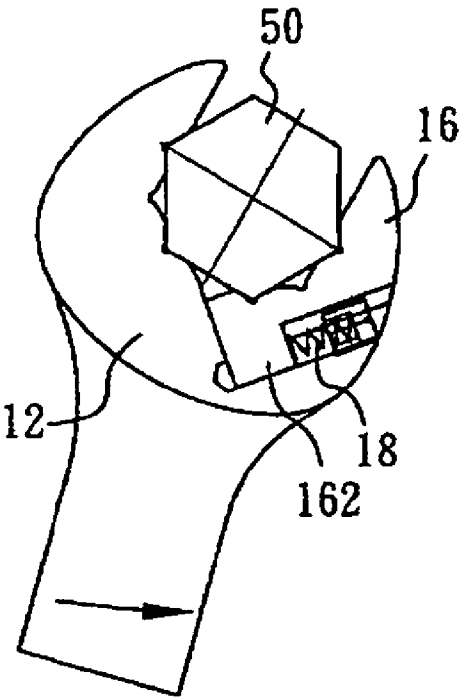
Figure 4E:
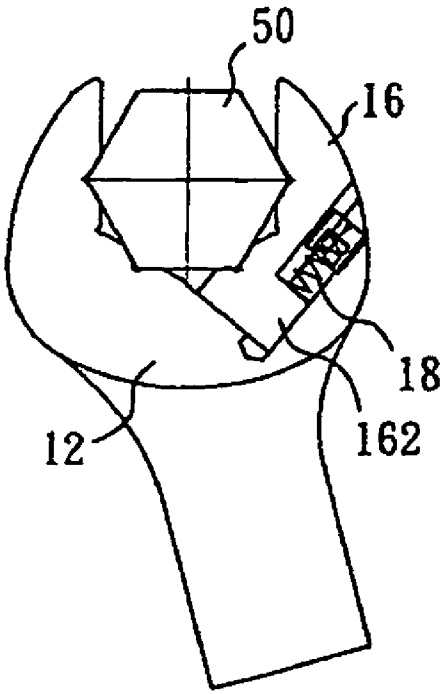

FIGS. 1 and 2 illustrate perspective views of a retractable open-end wrench 10 according to this invention. Wrench 10 comprises a web 12, a stationary jaw 14 projecting from a side of web 12, a movable jaw 16 provided at an opposite side of web 12 and forming an open end of a predetermined gap G with stationary jaw 14. Gap G preferably adapts to a width of a head of bolt or nut flats to which wrench 10 is designed to apply. For example, if the fastener has a hexagonal head, gap G is about the distance formed by two opposing, parallel flats of the head.

With reference to FIG. 1, web 12 is formed with a lower channel 122 at a location joining movable jaw 16 to allow for linear and resilient movement of movable jaw 16 with respect to web 12. Movable jaw 16 is formed with an upper channel 161 at location where jaw 16 joins with web 12. A post 162 projects from movable jaw 16 proximate upper channel 161.

With reference to FIG. 1(*a*), lower channel 122 has a major arc cross-section defined by an arc that exceeds a semi-circle (180 degrees), such as the ⅔ circle illustrated in FIG. 1(*a*). Upper channel 161 has a minor arc cross-section, such as the ⅓ circle illustrated in FIG. 1(*a*), and defines an arcuate shaped post 162 extending from the minor arc cross-section. Preferably, the minor arc has a radius slightly greater than a radius of the major arc. Upper channel 161 and lower channel 122 jointly construct a receiving hole H. Post 162 has a cross-section corresponding to the cross-section of lower channel 122. Because post 162 has a cross-section corresponding to the cross-section of lower channel 122, in installing movable jaw 16, post 162 is slid along and inserted into lower channel 122. Movable jaw 16 in this arrangement will not be separated from lower channel 122, and such an arrangement allows linear movement of movable jaw 16 along lower channel 122.

A resilient member 18 is received in receiving hole H. Resilient member 18 biases moveable jaw post 162 away from web 12 to thereby increase predetermined gap G. To allow easy retention of resilient member 18 in receiving hole H, according to the embodiment illustrated in FIGS. 1 and 2, a locking device 19 may be used to retain resilient member 18 in receiving hole H. Locking device 19 may be a bolt, plug or any other suitable device for sealing resilient member 18 in hole H. According to one embodiment of this invention, locking device 19 is a plug that is press-fit and secured into receiving hole H.

Lower channel 122 may alternatively be formed with a plurality of threads 123 at a distant end thereof for securing locking device 19 into receiving hole H, which is jointly constructed by upper channel 161 and lower channel 122. In this embodiment, post 162 includes a diameter that is substantially equivalent to the crest diameter of threads 123 in lower channel 122 to allow linear movement of post 162 along lower channel 122.

According to another embodiment of this invention, locking device 19 may also be designed to be a plug including an indent at an end thereof (FIGS. 3(*a*)–4(*e*)) for receiving resilient member 18 therein, which plug may then be press-fit into the receiving hole H. The resilient member 18 may alternatively be assembled to locking device 19 to construct a single unit prior to being press-fit rotated into receiving hole H.

If resilient member 18 is provided between post 162 and locking device 19 (FIG. 1), resilient member 18 may be a compression spring. If, however, resilient member 18 is alternatively provided between post 162 and web 12 (not shown), then resilient member 18 may be a tension spring. As such, post 162 is normally urged against web 12 by the resilience provided by resilient member 18.

The open end of wrench 10 may be designed to adapt to fasteners having heads of various configurations. FIGS. 1 and 2 illustrate an example adapted to a hexagonal head. The open end may be designed to adapt to other fasteners having square, polygonal, star-shaped, or even smooth cylindrical configuration by modifying the profile of the open end. As exemplified by an open end adapted to a fastener having a hexagonal head, the profile of the open end may be a lower half of an equilateral hexagon, or a lower half of a configuration constructed by interlacing two or more concentric equilateral hexagons, such as that shown in FIGS. 1 and 2. The profile of the open end adapted to a fastener having a cylindrical head may be a lower half of a circle, that to a triangular head may be a lower half of an equilateral triangle or a lower half of a configuration constructed by interlacing two or more concentric equilateral triangles, and that to a square head may be a lower half of a square or a lower half of a configuration constructed by interlacing two or more concentric squares.

The operations of the retractable open-end wrench 10 of this invention are illustrated in FIGS. 3(*a*)–3(*e*) and FIGS. 4(*a*)–4(*e*). FIGS. 3(*a*) to 3(*c*) are schematic views illustrating the operations for retracting the retractable open-end wrench to an orientation facilitating tightening. FIG. 3(*a*) illustrates a state in which a hexagonal bolt 50, which fits in the open end of retractable open-end wrench 10, has been tightened by a user to an orientation that is inconvenient for further rotation. At this point, the user may rotate web 12 of the wrench 10 in a reverse direction as shown in FIG. 3(*b*). Because the profile of the open end formed on movable jaw 16 is restrained by bolt 50 having a cooperative profile, post 162 projecting from movable jaw 16 is forced to move along an axis of receiving hole H jointly constructed by lower channel 122 and upper channel 161, to thereby increase predetermined gap G due to resilient movement of movable jaw 16 with respect to stationary jaw 14, so as to allow wrench 10 to rotate in a reverse direction under a state that wrench 10 is not removed from bolt 50.

Once wrench 10 reaches a position as shown in FIG. 3(*c*), wrench 10 begins to recover to an orientation facilitating further rotation and the user can at this time slightly release wrench 10 whereby movable jaw 16 approaches stationary jaw 14 due to resilient member 18 and returns to predetermined gap G, as shown in FIG. 3(*d*). At this time, the user can again rotate web 12 towards a direction for tightening bolt 50 to the position shown in FIG. 3(*e*). Because post 162 of movable jaw 16 happens to urge against web 12 at this time, movable jaw 16 and stationary jaw 14 can jointly drive bolt 50 to rotate towards the tightening direction. The operations illustrated in FIGS. 3(*a*) to 3(*d*) may be repeated until the bolt or nut is completely tightened.

With reference to FIG. 1(*b*), because the radius of upper channel 161 is slightly greater than the radius of lower channel 122, a slash S is formed between upper channel 161 and locking device 19. As such, when post 162 slides along lower channel 122, locking device 19 does not limit the movement of channel 161 or interferes with the linear movement of movable jaw 16.

FIGS. 4(*a*) to 4(*c*) are schematic views illustrating the operations for retracting the retractable open-end wrench to an orientation facilitating loosening. FIG. 4(*a*) illustrates a state in which hexagonal bolt 50 fits in the open end of retractable open-end wrench 10 and has been loosened by a user to an orientation that is inconvenient for further rotation. At this point, the user may rotate wrench web 12 in a reverse direction as shown in FIG. 4(*b*). Because the profile of the open end formed on movable jaw 16 is restrained by bolt 50 having a cooperative profile, movable jaw 16 is forced to move along an axis of the receiving hole H against the bias of resilient member 18 to thereby increase the predetermined gap G due to movement of movable jaw 16 with respect to stationary jaw 14. Thus, wrench 10 rotates in a reverse direction under a state that wrench 10 is not removed from bolt 50. The user continues rotating wrench web 12 in a reverse direction until reaching the position shown in FIG. 4(*c*). Once the configuration of bolt 50 happens to again adapt to the profile of the open end of wrench 10, wrench 10 recovers to an orientation facilitating further rotation as shown in FIG. 4(*d*). In this position, the user can slightly release wrench 10 whereby movable jaw 16 approaches stationary jaw 14 due to resilient member 18 and returns to assume the predetermined gap G with stationary jaw 14, as shown in FIG. 4(*d*). At this time, the user can again rotate web 12 towards a direction for loosening bolt 50 to the position shown in FIG. 4(*e*). Because moveable jaw post 162 is biased against web 12 in this position, movable jaw 16 and stationary jaw 14 can jointly drive bolt 50 in the loosening direction. The operations illustrated in FIGS. 4(*a*) to 4(*d*) may be repeated until the bolt or nut is completely loosened.

Because receiving hole H is jointly constructed by (1) lower channel 122 formed in web 12 that has a major arc cross-section and (2) upper channel 161 formed on movable jaw 16 that has a minor arc cross-section, in manufacturing the wrench only a driller is required to drill partially circular holes along lateral faces of web 12 and movable jaw 16 without the need to use milling machines. Such open, partially circular holes also facilitate deburring of the upper 161 and lower 122 channels that are machined to wrenches of different sizes. Thus, the wrench design of the present invention allow for easy manufacturing and deburring procedures to reduce the manufacturing costs and lead time.

Furthermore, in using retractable open-end wrench 10 of this invention, the user may quickly retract wrench 10 to an orientation facilitating further rotation without repeatedly removing the wrench. Thus, the present invention provides a retractable open-end wrench that allows for quick retraction of the wrench to an orientation facilitating further rotation and allowing tightening or loosening a fastener without repeatedly removing the wrench and fitting the wrench onto bolt 50.

This invention is related to a novel creation that makes a breakthrough in the art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. A retractable open-end wrench, comprising:

a. a web formed with a lower channel having a major arc cross-section containing an arc exceeding a semi-circle;

b. a stationary jaw projecting from a side of said web, c. a movable jaw in operative engagement with said lower channel and forming an open end of a predetermined gap with said stationary jaw, said moveable jaw having, (i) an upper channel proximate said web, said upper channel having a minor arc cross-section containing an arc beneath a semi-circle, said minor arc having a radius slightly greater than a radius of said major arc, said upper channel and said lower channel jointly constructing a receiving hole, (ii) a post projecting from said movable jaw at a location proximate said upper channel, said post having a cross-section corresponding to said cross-section of said lower channel to allow linear movement along said lower channel, and d. a spring received in said receiving hole, said spring subjecting said moveable jaw post to normally urge against said web and allowing linear movement of said movable jaw with respect to said web to thereby increase said predetermined gap.

2. The retractable open-end wrench of claim 1, further comprising a plug for retaining said spring in said receiving hole.

3. The retractable open-end wrench of claim 2, wherein said spring is a compression spring provided between said post and said plug.

4. The retractable open-end wrench of claim 1, wherein said spring is a tension spring provided between said post and said web.

5. The retractable open-end wrench of claim 2, wherein said plug is a bolt.

6. The retractable open-end wrench of claim 5, wherein said lower channel is formed with a plurality of threads at a distant end thereof for retaining said plug in said receiving hole.

7. The retractable open-end wrench of claim 5, wherein said spring is assembled to said bolt to construct a single unit.

8. The retractable open-end wrench of claim 2, wherein said plug is press-fit into said receiving hole.

9. The retractable open-end wrench of claim 8, wherein said plug includes an indent at an end thereof for receiving said spring therein.

10. The retractable open-end wrench of claim 8, wherein said spring is assembled to said plug to construct a single unit.

11. The retractable open-end wrench of claim 1, wherein said open end includes a profile adapted to a fastener having a hexagonal head.

12. The retractable open-end wrench of claim 1, wherein said open end includes a profile adapted to a fastener having a triangular head.

13. The retractable open-end wrench of claim 1, wherein said open end includes a profile adapted to a fastener having a square head.

14. The retractable open-end wrench of claim 1, wherein said open end includes a profile adapted to a fastener having a circular head.

15. A retractable open-end wrench comprising:

a. a web;

b. a stationary jaw projecting from a side of said web;

c. a movable jaw provided at another side of said web and forming a gap between said stationary jaw and said moveable jaw;

d. a first channel formed in said web adjacent said moveable jaw, said first channel defined by a first arc having a cross-section exceeding a semi-circle;

e. a second channel formed in said movable jaw adjacent said first channel, said second channel defined by a second arc having a cross-section of less than a semi-circle, said second channel having a first radius slightly greater than a second radius of said first channel, wherein said first channel and said second channel jointly form a receiving hole;

f. a post having a cross-section corresponding to said cross-section of said first channel to allow linear movement of said post within said first channel, said post being formed proximate said second channel; and g. a spring received in said receiving hole adjacent said post so that said spring biases said post between a first position wherein said gap is sized to apply force to a fastener in a first direction, and a second position wherein said gap is sized so that said wrench ratchets about the fastener in a second direction.

16. The retractable open-end wrench of claim 15, further comprising a plug for retaining said spring in said receiving hole.

17. The retractable open-end wrench of claim 16, wherein said spring is a compression spring located intermediate said post and said plug.

18. The retractable open-end wrench of claim 15, wherein said spring is a tension spring located intermediate said post and said web.

19. The retractable open-end wrench of claim 16, said first channel containing a first thread on an inner circumference thereof and said plug contains a second thread on an outer circumference thereof that interengage with said first thread.

20. The retractable open-end wrench of claim 16, wherein said spring is coupled to said plug prior to said plug being placed in said receiving hole.

21. The retractable open-end wrench of claim 16, wherein said plug is press-fit into said receiving hole.

22. The retractable open-end wrench of claim 16, wherein said plug defines a recessed chamber therein for receiving a portion of said spring.

23. The retractable open-end wrench of claim 15, wherein said gap defines a profile adapted to a fastener having a hexagonal head.

24. A retractable open-end wrench comprising:

a. a handle defining a web at one end thereof having, (i) a stationary jaw projecting from a first side of said web, and (ii) a first channel formed at a second side of said web opposite said first side, said first channel defined by a first arc;

b. a moveable jaw received by said first channel so that said moveable jaw traverses said first channel, wherein said jaws form a gap therebetween; and c. a second channel formed in said movable jaw proximate said first channel and defined by a second arc, wherein a length of said second arc is smaller than a length of said first arc, a first radius of said first arc is smaller than a second radius of said second arc, and said first channel and said second channel form a receiving hole.

25. The retractable open-end wrench of claim 24, said movable jaw further comprising a post having a cross-section corresponding to a cross-section of said first channel so that said post is received in said first channel.

26. The retractable open-end wrench of claim 25, further comprising a spring received in said receiving hole adjacent said post so that said spring biases said post between a first position wherein said gap is sized to apply force to a fastener in a first direction, and a second position wherein said gap is sized so that said wrench ratchets about the fastener in a second direction.

27. The retractable open-end wrench of claim 26, further comprising a plug for retaining said post in said first channel.

* * * * *